US009303229B2

(12) United States Patent
Nelson et al.

(10) Patent No.: US 9,303,229 B2
(45) Date of Patent: Apr. 5, 2016

(54) LUBRICATING OIL COMPOSITION

(71) Applicants: Chevron Oronite Company LLC, San Ramon, CA (US); Chevron U.S.A. Inc., San Ramon, CA (US)

(72) Inventors: Kenneth D. Nelson, Napa, CA (US); Alexander B. Boffa, Oakland, CA (US); William M. Kleiser, Lafayette, CA (US); Stephen D. Stults, Benicia, CA (US); James A. McGeehan, San Rafael, CA (US); Wim Van Dam, Bergschenhoek (NL); Richard E. Cherpeck, Cotati, CA (US)

(73) Assignees: Chevron U.S.A. Inc., San Ramon, CA (US); Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 14/103,094

(22) Filed: Dec. 11, 2013

(65) Prior Publication Data

US 2014/0100146 A1 Apr. 10, 2014

Related U.S. Application Data

(63) Continuation of application No. 13/398,972, filed on Feb. 17, 2012, now abandoned, and a continuation of application No. 12/316,894, filed on Dec. 17, 2008, now abandoned.

(51) Int. Cl.

| | |
|---|---|
| ***C10M 137/10*** | (2006.01) |
| ***C10M 173/02*** | (2006.01) |
| ***C10M 163/00*** | (2006.01) |
| ***C10M 141/12*** | (2006.01) |

(52) U.S. Cl.

CPC ..... *C10M 141/12* (2013.01); *C10M 163/00* (2013.01); *C10M 2201/087* (2013.01); *C10M 2203/1006* (2013.01); *C10M 2207/026* (2013.01); *C10M 2207/042* (2013.01); *C10M 2215/064* (2013.01); *C10M 2215/08* (2013.01); *C10M 2215/28* (2013.01); *C10M 2219/044* (2013.01); *C10M 2219/046* (2013.01); *C10M 2219/066* (2013.01); *C10M 2219/068* (2013.01); *C10M 2219/102* (2013.01); *C10M 2227/061* (2013.01); *C10M 2227/062* (2013.01); *C10M 2227/09* (2013.01); *C10N 2230/42* (2013.01); *C10N 2230/43* (2013.01); *C10N 2230/45* (2013.01); *C10N 2240/10* (2013.01); *C10N 2240/102* (2013.01); *C10N 2240/104* (2013.01); *C10N 2260/14* (2013.01)

(58) Field of Classification Search

CPC ..... C10M 2201/087; C10M 2219/046; C10M 2223/045

USPC ..... 508/156, 186, 379

See application file for complete search history.

(56) References Cited

U.S. PATENT DOCUMENTS

| | | | |
|---|---|---|---|
| 2,446,072 | A | 7/1948 | Armstrong |
| 3,313,727 | A | 4/1967 | Peeler |
| 3,356,702 | A | 12/1967 | Farmer et al. |
| 3,819,521 | A | 6/1974 | Sims |
| 3,853,772 | A | 12/1974 | Adams |
| 3,907,601 | A | 9/1975 | Schaefer |
| 3,997,454 | A | 12/1976 | Adams |
| 4,089,790 | A | 5/1978 | Adams |
| 4,098,705 | A | 7/1978 | Sakurai et al. |
| 4,259,194 | A | 3/1981 | de Vries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | de Vries et al. |
| 4,283,295 | A | 8/1981 | de Vries et al. |
| 4,285,822 | A | 8/1981 | de Vries et al. |
| 4,369,119 | A | 1/1983 | de Vries et al. |
| 4,370,246 | A | 1/1983 | de Vries et al. |
| 4,395,279 | A | 7/1983 | Houck |
| 4,402,840 | A | 9/1983 | de Vries et al. |
| 4,584,115 | A | 4/1986 | Davis |
| 4,648,985 | A | 3/1987 | Thorsell et al. |
| 5,631,213 | A | 5/1997 | Tanaka et al. |
| 6,372,696 | B1 | 4/2002 | Tipton |

(Continued)

FOREIGN PATENT DOCUMENTS

| | | |
|---|---|---|
| CA | 2210974 | 2/1996 |
| EP | 0737735 | 10/1996 |

(Continued)

OTHER PUBLICATIONS

U.S. Appl. No. 12/215,723, filed Jun. 30, 2008, Nelson et al.

U.S. Appl. No. 12/215,739, filed Jun. 30, 2008, Nelson et al.

Japanese Office Action issued in counterpart Japanese Patent Application No. 2011-542262 dated Nov. 29, 2013.

Spikes, Hugh "Low-and zero-sulphated ash, phosphorus and sulphur anti-wear additives for engine oils", Lubrication Science, 20:103-105, 2008.

Canter, Neil "Additve Challenges in Meeting New Automotive Engine Specifications", Tribology & Lubrication Technology, pp. 10-19, Sep. 2006.

Ludwig, Lawrence "Heavy-Duty Diesel Engine Oil Developments and Trends", Machinery Lubrication, May 2007.

(Continued)

*Primary Examiner* — Vishal Vasisth

(74) *Attorney, Agent, or Firm* — M. Carmen & Associates, PLLC

(57) ABSTRACT

A lubricating oil composition having a sulfur content of up to about 0.4 wt. % and a sulfated ash content of up to about 0.5 wt. % as determined by ASTM D874 is disclosed which comprises (a) a major amount of an oil of lubricating viscosity; (b) at least one oil-soluble or dispersed oil-stable boron-containing compound having no more than about 400 ppm of boron; and (c) at least one oil-soluble or dispersed oil-stable molybdenum-containing compound having at least about 1100 ppm of molybdenum, based upon the total mass of the composition; wherein the lubricating oil composition has a ratio of sulfur to molybdenum of less than or equal to about 4:1.

24 Claims, No Drawings

(56) References Cited

U.S. PATENT DOCUMENTS

| | | | |
|---|---|---|---|
| 6,534,450 | B1 | 3/2003 | Harrison et al. |
| 6,737,387 | B2 | 5/2004 | Harrison et al. |
| 6,777,378 | B2 | 8/2004 | Abraham et al. |
| 6,855,675 | B1 | 2/2005 | Yamada et al. |
| 6,962,896 | B2 | 11/2005 | Ruhe, Jr. et al. |
| 7,026,273 | B2 | 4/2006 | Robson et al. |
| 2002/0019320 | A1 | 2/2002 | Nakazato et al. |
| 2003/0148895 | A1 | 8/2003 | Robson et al. |
| 2003/0158048 | A1 | 8/2003 | Farng et al. |
| 2003/0216266 | A1 | 11/2003 | Hirano et al. |
| 2005/0043191 | A1 | 2/2005 | Farng et al. |
| 2005/0070444 | A1 | 3/2005 | Shaw et al. |
| 2005/0070445 | A1 | 3/2005 | Nelson et al. |
| 2005/0153850 | A1 | 7/2005 | Nelson et al. |
| 2005/0209111 | A1 | 9/2005 | Ruhe et al. |
| 2006/0014653 | A1 | 1/2006 | Busse et al. |
| 2006/0172896 | A1 | 8/2006 | Conroy et al. |
| 2006/0264342 | A1 | 11/2006 | Shaw et al. |
| 2006/0276353 | A1 | 12/2006 | Irving et al. |
| 2007/0123437 | A1 | 5/2007 | Boffa et al. |
| 2008/0128322 | A1 | 6/2008 | Van Dam et al. |
| 2008/0171677 | A1 | 7/2008 | Buck et al. |
| 2009/0082234 | A1 | 3/2009 | Devlin et al. |
| 2009/0203561 | A1 | 8/2009 | Kamano |

FOREIGN PATENT DOCUMENTS

| | | | |
|---|---|---|---|
| EP | 1167497 | A2 | 1/2002 |
| EP | 1310549 | B1 | 5/2003 |
| EP | 1361263 | A1 | 11/2003 |
| EP | 1661970 | A1 | 5/2006 |
| EP | 1918357 | | 5/2008 |
| EP | 1997871 | A1 | 12/2008 |
| JP | 2010183154 | A | 7/1998 |
| JP | 2002129182 | A | 5/2002 |
| JP | 2004 149762 | | 5/2004 |
| JP | 2005-306913 | | 4/2005 |
| WO | 03/064568 | A2 | 8/2003 |
| WO | 03/070863 | A2 | 8/2003 |
| WO | 2007/120712 | A2 | 10/2007 |
| WO | 2007115042 | | 10/2007 |
| WO | 2008029756 | | 3/2008 |
| WO | 2008050717 | | 5/2008 |
| WO | 2010/077755 | A2 | 7/2010 |
| WO | 2010/077757 | A2 | 7/2010 |

OTHER PUBLICATIONS

McGeehan, James A. "API CJ-4 The Most Robust Diesel Engine Oil Category for All Engines", Lubrication Magazine, pp. 1-20, Mar. 2008.

McGeehan, James A. "API CJ-4 New Oil Category for 2007 Low Emission Diesel Engines Using Particulate Filters", 15th International Colloquim Tribology-Automotive and Industrial Lubrication; pp. 1-21, Jan. 17-19, 2006.

API CJ-4 Performance Requirements, Performance Specification.

ACEA European Oil Sequences, Feb. 2007,.

Spikes, Hugh, Lubrication Science, 20:77-78, 2008.

Mortier et al., "Chemistry and Technology of Lubricants", Second Edition, pp. 332-340, 1997.

Stachowiak, Gwidon W., "Wear-Materials, Mechanisms and Practice", Tribology in Practice Series, pp. 85-88, 2005.

Lin et al., "Friction and Wear of Low-Phosphorus Engine Oils with Additional Molybdenum and Boron Compounds, Measured on a Reciproacting Lubricant Tester", Tribology Transactions, 51:659-672, 2008.

Kim et al., "Synergistic Lubricating Effect of Several Ashless Dithiocarbamates with Mo-Donor Addtives", Tribology International, 40:397-404, 2007.

Gatto et al., "Automotive Lubricant Testing and Additive Development" Journal of ASTM International, vol. 4, No. 7, Paper ID JA1100849, 2007.

Givens et al., Lube Formulation Effects on Transfer of Elements to Exhaust Atter-Treatment System Components, SAE Technical Paper Series, Powertrain & Fluid Systems Conference & Exhibition, Pittsburgh, PA, pp. 1-15, 2003.

Mortier et al., Chemistry and Technology of Lubricants, p. 107, 1993.

LUBRICATING OIL COMPOSITION

PRIORITY

This application is a CON of Ser. No. 13/398,972, filed Feb. 17, 2012, now abandoned and is a CON of Ser. No. 12/316,894, filed Dec. 17, 2008, now abandoned.

BACKGROUND OF THE INVENTION

1. Technical Field

The present invention generally relates to lubricating oil compositions.

2. Description of the Related Art

Exhaust after-treatment devices, equipped on internal combustion engines to comply with emission regulations, have proven to be sensitive to the combustion by products of the fuel and lubricant used in the engine. In addition, certain types of devices are sensitive to one or more of the following: (1) phosphorus coming from the lubricant, (2) sulfur coming from both fuel and lubricant, and (3) sulfated ash resulting from the combustion of fuel and lubricant. In order to ensure the durability of the different types of after-treatment devices, special lubricants are being developed that feature relatively low levels of, for example, sulfur, phosphorus, and sulfated ash.

U.S. Patent Application Publication No. 20050043191 ("the '191 application") discloses a lubricating oil composition having less than 2000 ppm sulfur and free of zinc and phosphorus. The '191 application further discloses that the lubricating oil composition has a minimum of 120 ppm of boron and a minimum of 80 ppm of molybdenum. Each of the examples shown in Table 1 of the '191 application disclose an ash content of 0.96, 0.99 and 1.05 for Oils 1, 2, and 3, respectively.

U.S. Pat. No. 6,777,378 ("the '378 patent") discloses a lubricating oil composition containing (a) a base oil; (b) a molybdenum- and sulfur-containing composition derived from a basic nitrogen-containing compound, a molybdenum compound and carbon disulfide; (c) a borate ester; and (d) optionally a phosphorus-containing compound provided that the phosphorus content of the composition does not exceed about 0.10 wt. %. The '378 patent further discloses that the lubricating oil composition has a boron content of about 30 ppm to about 600 ppm and a molybdenum content of about 25 ppm to about 800 ppm.

U.S. Pat. No. 7,026,273 ("the '273 patent") discloses a lubricating oil composition containing a major amount of oil of lubricating viscosity, and a minor amount of a boron-containing additive, a detergent additive composition and one or more co-additives. The '273 patent further discloses that the lubricating oil composition has a boron content of greater than 150 ppm, a molybdenum content of at most 1000 ppm and less than 4000 ppm by mass of sulfur.

EP 0 737 735 ("the 735 application") discloses a lubricant composition produced by blending (a) a Mo-containing friction conditioner; and (b) a B-containing compound with a lubricant base oil. The 735 application further discloses that the lubricating oil composition has a boron content of greater than 0.015 wt. % (150 ppm) and a molybdenum content of 100 ppm to 2000 ppm.

It is desirable to develop improved lubricating oil compositions which exhibit improved deposit reduction, as well as wear and oxidation inhibition when used in an internal combustion engine.

SUMMARY OF THE INVENTION

In accordance with one embodiment of the present invention, a lubricating oil composition having a sulfur content of up to about 0.4 wt. % and a sulfated ash content of up to about 0.5 wt. % as determined by ASTM D874 is provided which comprises (a) a major amount of an oil of lubricating viscosity; (b) at least one oil-soluble or dispersed oil-stable boron-containing compound having no more than about 400 ppm of boron, based upon the total mass of the composition; and (c) at least one oil-soluble or dispersed oil-stable molybdenum-containing compound having at least about 1100 ppm of molybdenum, based upon the total mass of the composition; wherein the lubricating oil composition has a ratio of sulfur to molybdenum of less than or equal to about 4:1.

In accordance with a second embodiment of the present invention, there is provided a method of operating an internal combustion engine which comprises operating the internal combustion engine with a lubricating oil composition having a sulfur content of up to about 0.4 wt. % and a sulfated ash content of up to about 0.5 wt. % as determined by ASTM D874 and comprising (a) a major amount of an oil of lubricating viscosity; (b) at least one oil-soluble or dispersed oil-stable boron-containing compound having no more than about 400 ppm of boron, based upon the total mass of the composition; and (c) at least one oil-soluble or dispersed oil-stable molybdenum-containing compound having at least about 1100 ppm of molybdenum, based upon the total mass of the composition; wherein the lubricating oil composition has a ratio of sulfur to molybdenum of less than or equal to about 4:1.

In accordance with a third embodiment of the present invention, there is provided an internal combustion engine lubricated with a lubricating oil composition having a sulfur content of up to about 0.4 wt. % and a sulfated ash content of up to about 0.5 wt. % as determined by ASTM D874 and comprising (a) a major amount of an oil of lubricating viscosity; (b) at least one oil-soluble or dispersed oil-stable boron-containing compound having no more than about 400 ppm of boron, based upon the total mass of the composition; and (c) at least one oil-soluble or dispersed oil-stable molybdenum-containing compound having at least about 1100 ppm of molybdenum, based upon the total mass of the composition; wherein the lubricating oil composition has a ratio of sulfur to molybdenum of less than or equal to about 4:1.

The molybdenum-containing lubricating oil compositions of the present invention advantageously provide high wear inhibition when used in an internal combustion engine while containing relatively low levels of sulfated ash content. In addition, the high wear inhibition can be achieved with the molybdenum-containing lubricating oil compositions of the present invention while also employing relatively low levels (or substantially free) of any phosphorus and zinc content.

DETAILED DESCRIPTION OF THE PREFERRED EMBODIMENTS

The present invention is directed to a lubricating oil composition having a sulfur content of up to about 0.4 wt. % and a sulfated ash content of up to about 0.5 wt. % as determined by ASTM D874 and containing at least (a) a major amount of an oil of lubricating viscosity; (b) at least one oil-soluble or dispersed oil-stable boron-containing compound having no more than about 400 ppm of boron, based upon the total mass of the composition; and (c) at least one oil-soluble or dispersed oil-stable molybdenum-containing compound having at least about 1100 ppm of molybdenum, based upon the total mass of the composition; wherein the lubricating oil composition has a ratio of sulfur to molybdenum of less than or equal to about 4:1. In one embodiment, the lubricating oil composition of the present invention has a sulfur content of up to about 0.3 wt. %, and/or sulfated ash content of up to about 0.4 wt. % as determined by ASTM D874. The amount of sulfur, boron, molybdenum or phosphorus in the lubricating oil composition of the present invention is measured according to ASTM D4951.

The oil of lubricating viscosity for use in the lubricating oil compositions of this invention, also referred to as a base oil, is typically present in a major amount, e.g., an amount of greater than 50 wt. %, preferably greater than about 70 wt. %, more preferably from about 80 to about 99.5 wt. % and most preferably from about 80 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. For example, the base oils can be used in formulating lubricating oil compositions for any and all such applications such as passenger car engine oils, heavy duty diesel motor oils and natural gas engine oils. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C). Generally, individually the base oils used as engine oils will have a kinematic viscosity range at 10° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30 or 15W-40. Oils used as gear oils can have viscosities ranging from about 2 cSt to about 2000 cSt at 100° C.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fischer-Tropsch process. For example, a suitable base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Although Group II, III and IV base oils are preferred for use in this invention, these base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof, alkylbenzenes such as dodecylbenzenes, tetradecylbenzenes, dinonylbenzenes, di(2-ethylhexyl)-benzenes, and the like, polyphenyls such as biphenyls, terphenyls, alkylated polyphenyls, and the like, alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils include, but are not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500-1000, diethyl ether of polypropylene glycol having a molecular weight of 1,000-1,500, etc.) or mono- and polycarboxylic esters thereof such as, for example, the acetic esters, mixed $C_3$-$C_8$ fatty acid esters, or the $C_{13}$ oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl)silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorus containing acids, e.g., tricresyl phosphate, trioctyl phosphate, diethyl ester of decane phosphionic acid, etc., polymeric tetrahydrofurans, and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The Oil-Soluble or Dispersed Oil-Stable Boron-Containing Compound

Representative examples of at least one oil-soluble or dispersed oil-stable boron-containing compound for use in the lubricating oil compositions of the present invention include a borated dispersant; a borated friction modifier; a dispersed alkali metal or a mixed alkali metal or an alkaline earth metal borate, a borated epoxide, a borate ester, a borated fatty amine, a borated amide, a borated sulfonate, and the like, and mixtures thereof.

Examples of borated dispersants include, but are not limited to, borated ashless dispersants such as the borated polyalkenyl succinic anhydrides; borated non-nitrogen containing derivatives of a polyalkylene succinic anhydride; a borated basic nitrogen compound selected from the group consisting of succinimides, carboxylic acid amides, hydrocarbyl monoamines, hydrocarbyl polyamines, Mannich bases, phosphonoamides, thiophosphonamides and phosphoramides, thiazoles, e.g., 2,5-dimercapto-1,3,4-thiadiazoles, mercaptobenzothiazoles and derivatives thereof, triazoles, e.g., alkyltriazoles and benzotriazoles, copolymers which contain a carboxylate ester with one or more additional polar function, including amine, amide, imine, imide, hydroxyl, carboxyl, and the like, e.g., products prepared by copolymerization of long chain alkyl acrylates or methacrylates with monomers of the above function; and the like and mixtures thereof. A preferred borated dispersant is a succinimide derivative of boron such as, for example, a borated polyisobutenyl succinimide.

Examples of borated friction modifiers include, but are not limited to, borated fatty epoxides, borated alkoxylated fatty amines, borated glycerol esters and the like and mixtures thereof.

The hydrated particulate alkali metal borates are well known in the art and are available commercially. Representative examples of hydrated particulate alkali metal borates and methods of manufacture include those disclosed in, e.g., U.S. Pat. Nos. 3,313,727; 3,819,521; 3,853,772; 3,907,601; 3,997,454; 4,089,790; 6,737,387 and 6,534,450, the contents of which are incorporated herein by reference. The hydrated alkali metal borates can be represented by the following Formula: $M_2O.mB_2O_3.nH_2O$ where M is an alkali metal of atomic number in the range of about 11 to about 19, e.g., sodium and potassium; m is a number from about 2.5 to about 4.5 (both whole and fractional); and n is a number from about 1.0 to about 4.8. Preferred are the hydrated sodium borates. The hydrated borate particles generally have a mean particle size of less than about 1 micron.

Examples of borated epoxides include borated epoxides obtained from the reaction product of one or more of the boron compounds with at least one epoxide. Suitable boron compounds include boron oxide, boron oxide hydrate, boron trioxide, boron trifluoride, boron tribromide, boron trichloride, boron acids such as boronic acid, boric acid, tetraboric acid and metaboric acid, boron amides and various esters of boron acids. The epoxide is generally an aliphatic epoxide having from about 8 to about 30 carbon atoms and preferably from about 10 to about 24 carbon atoms and more preferably from about 12 to about 20 carbon atoms. Suitable aliphatic epoxides include dodecene oxide, hexadecene oxide and the like and mixtures thereof. Mixtures of epoxides may also be used, for instance commercial mixtures of epoxides having from about 14 to about 16 carbon atoms or from about 14 to about 18 carbon atoms. The borated epoxides are generally known and described in, for example, U.S. Pat. No. 4,584,115.

Examples of borate esters include those borate esters obtained by reacting one or more of the boron compounds disclosed above with one or more alcohols of suitable oleophilicity. Typically, the alcohols will contain from 6 to about 30 carbons and preferably from 8 to about 24 carbon atoms. The methods of making such borate esters are well known in the art. The borate esters can also be borated phospholipids. Representative examples of borate esters include those having the structures set forth in Formulae I-III:

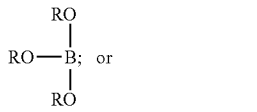

(I)

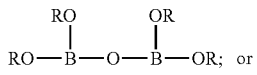

(II)

-continued (III)

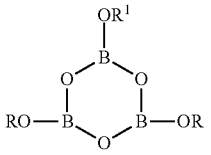

wherein each R is independently a $C_1$-$C_{12}$ straight or branched alkyl group and $R^1$ is hydrogen or a $C_1$-$C_{12}$ straight or branched alkyl group.

Examples of borated fatty amines include borated fatty amines obtained by reacting one or more of the boron compounds disclosed above with one or more of fatty amines, e.g., an amine having from about fourteen to about eighteen carbon atoms. The borated fatty amines may be prepared by reacting the amine with the boron compound at a temperature in the range of from about 50 to about 300° C., and preferably from about 100 to about 250° C., and at a ratio from about 3:1 to about 1:3 equivalents of amine to equivalents of boron compound.

Examples of borated amides include borated amides obtained from the reaction product of a linear or branched, saturated or unsaturated monovalent aliphatic acid having 8 to about 22 carbon atoms, urea, and polyalkylenepolyamine with a boric acid compound and the like and mixtures thereof.

Examples of borated sulfonates include borated alkaline earth metal sulfonates obtained by (a) reacting in the presence of a hydrocarbon solvent (i) at least one of an oil-soluble sulfonic acid or alkaline earth sulfonate salt or mixtures thereof, (ii) at least one source of an alkaline earth metal; (iii) at least one source of boron, and (iv) from 0 to less than 10 mole percent, relative to the source of boron, of an overbasing acid, other than the source of boron; and (b) heating the reaction product of (a) to a temperature above the distillation temperature of the hydrocarbon solvent to distill the hydrocarbon solvent and water from the reaction. Suitable borated alkaline earth metal sulfonates include those disclosed in, for example, U.S. Patent Application Publication No. 20070123437, the contents of which are incorporated by reference herein.

The lubricating oil compositions of the present invention will contain no more than about 400 ppm of boron, based upon the total mass of the composition, provided from the one or more oil-soluble or dispersed oil-stable boron-containing compounds. In one embodiment, the lubricating oil compositions of the present invention will contain no more than about 300 ppm of boron, based upon the total mass of the composition, provided from the one or more oil-soluble or dispersed oil-stable boron-containing compounds. In another embodiment, the lubricating oil compositions of the present invention will contain no more than about 200 ppm of boron, based upon the total mass of the composition, provided from the one or more oil-soluble or dispersed oil-stable boron-containing compounds. In yet another embodiment, the lubricating oil compositions of the present invention will contain no more than about 100 ppm of boron, based upon the total mass of the composition, provided from the one or more oil-soluble or dispersed oil-stable boron-containing compounds. In another embodiment, the lubricating oil compositions of the present invention will contain from about 40 ppm to no more than about 400 ppm of boron, based upon the total mass of the composition, provided from the one or more oil-soluble or dispersed oil-stable boron-containing compounds. In still yet another embodiment, the lubricating oil compositions of the present invention will be substantially free of any boron content.

The Oil-Soluble or Dispersed Oil-Stable Molybdenum-Containing Compound

Representative examples of at least one oil-soluble or dispersed oil-stable molybdenum-containing compound for use in the lubricating oil compositions of the present invention include molybdenum dithiocarbamates; molybdenum dithiophosphates; dispersed hydrated molybdenum compounds; acidic molybdenum compounds or salts of acidic molybdenum compounds; molybdenum-containing complexes and the like and mixtures thereof.

Examples of dispersed hydrated molybdenum compounds include dispersed hydrated polymolybdates, dispersed hydrated alkali metal polymolybdates and the like and mixtures thereof. Suitable dispersed hydrated polymolybdates include those disclosed in, for example, U.S. Patent Application Publication No. 20050070445, the contents of which are incorporated by reference herein.

Suitable molybdenum dithiocarbamates include any molybdenum dithiocarbamate which can be used as an additive for lubricating oils. One class of molybdenum dithiocarbamates for use herein is represented by Formula IV:

(IV)

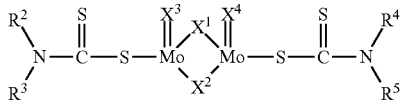

wherein $R^2$, $R^3$, $R^4$, and $R^5$ are each independently hydrogen or a hydrocarbon group including, by way of example, alkyl groups, alkenyl groups, aryl groups, cycloalkyl groups and cycloalkenyl groups, and $X^1$, $X^2$, $X^3$ and $X^4$ are each independently sulfur or oxygen.

Suitable alkyl groups include, but are not limited to, methyl, ethyl, propyl, isopropyl, butyl, isobutyl, secondary butyl, tertiary butyl, pentyl, isopentyl, secondary pentyl, neopentyl, tertiary pentyl, hexyl, secondary hexyl, heptyl, secondary heptyl, octyl, 2-ethylhexyl, secondary octyl, nonyl, secondary nonyl, decyl, secondary decyl, undecyl, secondary undecyl, dodecyl, secondary dodecyl, tridecyl, isotridecyl, secondary tridecyl, tetradecyl, secondary tetradecyl, hexadecyl, secondary hexadecyl, stearyl, icosyl, docosyl, tetracosyl, triacontyl, 2-butyloctyl, 2-butyldecyl, 2-hexyloctyl, 2-hexyldecyl, 2-octyldecyl, 2-hexyldodecyl, 2-octyldodecyl, 2-decyltetradecyl, 2-dodecylhexadecyl, 2-hexadecyloctadecyl, 2-tetradecyloctadecyl, monomethyl branched-isostearyl and the like.

Suitable alkenyl groups include, but are not limited to, vinyl, allyl, propenyl, butenyl, isobutenyl, pentenyl, isopentenyl, hexenyl, heptenyl, octenyl, nonenyl, decenyl, undecenyl, dodecenyl, tetradecenyl, oleyl and the like.

Suitable aryl groups include, but are not limited to, phenyl, tolyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, biphenyl, benzylphenyl, styrenated phenyl, p-cumylphenyl, alpha-naphthyl, beta-naphthyl groups and the like.

Suitable cycloalkyl groups and cycloalkenyl groups include, but are not limited to, cyclopentyl, cyclohexyl, cycloheptyl, methylcyclopentyl, methylcyclohexyl, methylcycloheptyl, cyclopentenyl, cyclohexenyl, cycloheptenyl, methylcyclopentenyl, methylcyclohexenyl, methylcycloheptenyl groups and the like.

Of these groups, the alkyl groups or alkenyl groups are preferred as $R^2$ to $R^5$ in Formula IV. Preferably, the R groups in Formula IV are identical groups.

In Formula IV, $X^1$ to $X^4$ are independently selected from sulfur or oxygen atom, and all of $X^1$ to $X^4$ may be a sulfur atom or an oxygen atom, or a mixture of sulfur atoms and oxygen atoms. In consideration of balance between friction reducing effect and corrosivity, the molar ratio (ratio of numbers) of sulfur atom(s)/oxygen atom(s) should particularly preferably be in the range from about ⅓ to about 3/1.

Some of the oil-soluble or dispersed oil-stable molybdenum compounds of Formula IV are commercially available. For example, products where $X^1$ and $X^2$ are O, $X^3$ and $X^4$ are S, and where $R^2$ to $R^5$ are $C_{13}H_{27}$ aliphatic hydrocarbyl groups and where the molybdenum is in oxidation state V are sold under the trademarks Molyvan 807 and Molyvan 822 as antioxidants and friction reducing additives by R.T. Vanderbilt Company Inc. (Norwalk, Conn. USA). These molybdenum compounds may be prepared by the methods described in U.S. Pat. No. 3,356,702 wherein $MoO_3$ is converted to soluble molybdate by dissolving in alkali metal hydroxide solution, neutralized by the addition of acid followed by the addition of a secondary amine and carbon disulfide. In another aspect, the molybdenum compounds of Formula I wherein $X^1$ to $X^4$ are O or S may be prepared by a number of methods known in the art such as, for example, U.S. Pat. Nos. 4,098,705 and 5,631,213.

Generally, the sulfurized oxymolybdenum dithiocarbamates represented by Formula IV can be prepared by reacting molybdenum trioxide or a molybdate with an alkali sulfide or an alkali hydrosulfide, and subsequently adding carbon disulfide and a secondary amine to the reaction mixture and reacting the resultant mixture at an adequate temperature. To prepare the asymmetric sulfurized oxymolybdenum dithiocarbamates, the use of a secondary amine having different hydrocarbon groups or the use of two or more different secondary amines in the above process is sufficient. The symmetric sulfurized oxymolybdenum dithiocarbamates can also be prepared in a similar manner, but with the use of only one secondary amine.

Examples of suitable molybdenum dithiocarbamate compounds include, but are not limited to, sulfurized molybdenum diethyldithiocarbamate, sulfurized molybdenum dipropyldithiocarbamate, sulfurized molybdenum dibutyldithiocarbamate, sulfurized molybdenum dipentyldithiocarbamate, sulfurized molybdenum dihexyldithiocarbamate, sulfurized molybdenumn dioctyldithiocarbamate, sulfurized molybdenum didecyldithiocarbamate, sulfurized molybdenum didodecyldithiocarbamate, sulfurized molybdenum ditridecyldithiocarbamate, sulfurized molybdenum di(butylphenyl)dithiocarbamate, sulfurized molybdenum di(nonylphenyl)dithiocarbamate, sulfurized oxymolybdenum diethyldithiocarbamate, sulfurized oxymolybdenum dipropyldithiocarbamate, sulfurized oxymolybdenum dibutyldithiocarbamate, sulfurized oxymolybdenum dipentyldithiocarbamate, sulfurized oxymolybdenum dihexyldithiocarbamate, sulfurized oxymolybdenum dioctyldithiocarbamate, sulfurized oxymolybdenum didecyldithiocarbamate, sulfurized oxymolybdenum didodecyldithiocarbamate, sulfurized oxymolybdenum ditridecyldithiocarbamate, sulfurized oxymolybdenum di(butylphenyl)dithiocarbamate, sulfurized oxymolybdenum di(nonylphenyl)dithiocarbamate, all of which the alkyl groups may be straight-chain or branched, and the like and mixtures thereof.

Suitable molybdenum dithiophosphates include any molybdenum dithiophosphate which can be used as an additive for lubricating oils. Examples of suitable molybdenum dithiophosphates include molybdenum dialkyl or diaryl dithiophosphate such as molybdenum diisopropyldithiophosphate, molybdenum di-(2-ethylhexyl)dithiophosphate, molybdenum di-(nonylphenyl)dithiophosphate and the like and mixtures thereof.

The molybdenum-containing complexes may be generally characterized as containing a molybdenum or molybdenum/sulfur complex of a basic nitrogen compound. The molybdenum/nitrogen-containing complexes employed herein are well known in the art and are complexes of molybdic acid and an oil-soluble basic nitrogen-containing compound. Generally, the molybdenum/nitrogen-containing complex can be made with an organic solvent comprising a polar promoter during a complexation step and procedures for preparing such complexes are described, for example, in U.S. Pat. Nos. 4,259,194; 4,259,195; 4,261,843; 4,263,152; 4,265,773; 4,283,295; 4,285,822; 4,369,119; 4,370,246; 4,394,279; 4,402,840; and 6,962,896 and U.S. Patent Application Publication No. 2005/0209111. As shown in these references, the molybdenum/nitrogen-containing complex can further be sulfurized.

In another embodiment, a molybdated succinimide complex can be prepared by a process which involves at least (a) reacting an alkyl or alkenyl succinimide of a polyamine of Formula V:

(V)

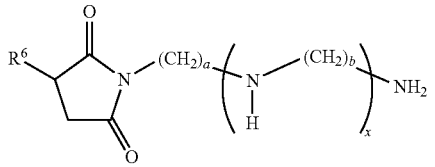

wherein $R^6$ is an about $C_{12}$ to about $C_{30}$ alkyl or alkenyl group; a and b are independently 2 or 3, and x is 0 to 10, preferably 1 to 6 and more preferably 2 to 5, with an ethylenically unsaturated carboxylic acid and/or anhydride thereof, and (b) reacting the succinimide product of step (a) with an acidic molybdenum compound, e.g., as disclosed in U.S. patent application Ser. No. 12/215,723, filed on Jun. 30, 2008, the contents of which are incorporated by reference herein. In one embodiment, the $R^6$ substituent has a number average molecular weight ranging from about 167 to about 419 and preferably from about 223 to about 279. In another embodiment, $R^6$ is an about $C_{12}$ to about $C_{24}$ alkyl or alkenyl group; a and b are each 2; and x is 2 to 5.

In step (a), a succinimide of Formula V:

(V)

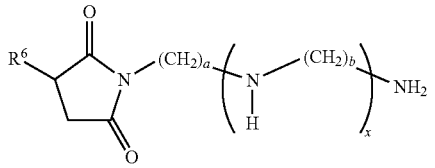

wherein $R^6$, a, b and x have the aforestated meanings, is reacted with an ethylenically unsaturated carboxylic acid. The starting succinimide of Formula V can be obtained by reacting an anhydride of Formula VI:

(VI)

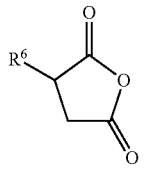

wherein $R^6$ has the aforestated meaning with a polyamine. The anhydride of Formula VI is either commercially available from such sources as, for example, Sigma Aldrich Corporation (St. Louis, Mo., U.S.A.), or can be prepared by any method well known in the art.

Suitable polyamines for use in preparing the succinimide of Formula V are polyalkylene polyamines, including polyalkylene diamines. Such polyalkylene polyamines will typically contain about 2 to about 12 nitrogen atoms and about 2 to 24 carbon atoms. Particularly suitable polyalkylene polyamines are those having the Formula: $H_2N—(R^7NH)_c—H$ wherein $R^7$ is a straight- or branched-chain alkylene group having 2 or 3 carbon atoms and c is 1 to 9. Representative examples of suitable polyalkylene polyamines include ethylenediamine, diethylenetriamine, triethylenetetraamine, tetraethylenepentamine, and mixtures thereof. Most preferably, the polyalkylene polyamine is tetraethylenepentamine.

Many of the polyamines suitable for use in the present invention are commercially available and others may be prepared by methods which are well known in the art. For example, methods for preparing amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99-116.

Generally, the anhydride of Formula VI is reacted with the polyamine at a temperature of about 130° C. to about 220° C. and preferably from about 145° C. to about 175° C. The reaction can be carried out under an inert atmosphere, such as nitrogen or argon. The amount of anhydride of Formula VI employed in the reaction can range from about 30 to about 95 wt. % and preferably from about 40 to about 60 wt. %, based on the total weight of the reaction mixture.

Suitable ethylenically unsaturated carboxylic acids or their anhydrides include ethylenically unsaturated monocarboxylic acids or their anhydrides, ethylenically unsaturated dicarboxylic acids or their anhydrides and the like and mixtures thereof. Useful monocarboxylic acids or their anhydrides include, but are not limited to, acrylic acid, methacrylic acid, and the like and mixtures thereof. Useful ethylenically unsaturated dicarboxylic acids or their anhydrides include, but are not limited to, fumaric acid, maleic anhydride, mesaconic acid, citraconic acid, citraconic anhydride, itaconic acid, itaconic anhydride, and the like and mixtures thereof. A preferred ethylenically unsaturated carboxylic acid or anhydride thereof is maleic anhydride or a derivative thereof. This and similar anhydrides bond onto the succinimide starting compound to provide a carboxylic acid functionality. The treatment of the succinimide of Formula V with the ethylenically unsaturated carboxylic acid or anhydrides thereof advantageously allows for a sufficient amount of the molybdenum compound to be incorporated into the complex.

Generally, the ethylenically unsaturated carboxylic acid or its anhydride is heated to a molten condition at a temperature in the range of from about 50° C. to about 100° C. and is thereafter mixed with the succinimide of Formula V. The molar ratio of ethylenically unsaturated carboxylic acid or its anhydride to succinimide of Formula V will vary widely, e.g., a range of from about 0.1:1 to about 2:1. In one embodiment, the charge molar ratio of ethylenically unsaturated carboxylic acid or its anhydride to succinimide of Formula V will range of from about 0.9:1 to about 1.05:1.

The molybdenum compounds used to prepare the molybdated succinimide complex of the present invention are acidic molybdenum compounds or salts of acidic molybdenum compounds. Generally, these molybdenum compounds are hexavalent. Representative examples of suitable molybdenum compounds can be any of the acid molybdenum compounds discussed above. Particularly preferred is molybdenum trioxide.

In step (b), a mixture of the succinimide product of step (a) and acidic molybdenum compound is prepared with or without a diluent. A diluent is used, if necessary, to provide a suitable viscosity for stirring. Suitable diluents are lubricating oils and liquid compounds containing only carbon and hydrogen. If desired, ammonium hydroxide may also be added to the reaction mixture to provide a solution of ammonium molybdate.

Generally, the reaction mixture is heated at a temperature less than or equal to about 100° C. and preferably from about 80° C. to about 100° C. until the molybdenum is sufficiently reacted. The reaction time for this step is typically in the range of about 15 minutes to about 5 hours and preferably about 1 to about 2 hours. The molar ratio of the molybdenum compound to the succinimide product of step (a) is about 0.1:1 to about 2:1, preferably from about 0.5:1 to about 1.5:1 and most preferably about 1:1. Any water present following the reaction of the molybdenum compound and succinimide product of step (a) can be removed by heating the reaction mixture to a temperature greater than about 100° C., and preferably from about 120° C. to about 160° C.

In another embodiment, a molybdated succinimide complex can be prepared by a process which involves at least (a) reacting a succinimide of a polyamine of Formula (VII)

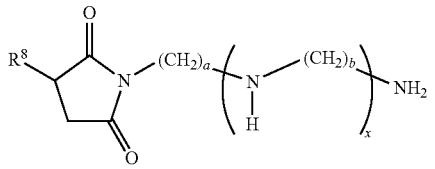

wherein $R^8$ is a hydrocarbon radical having a number average molecular weight of about 500 to about 5,000, preferably a number average molecular weight of about 700 to about 2,500 and more preferably a number average molecular weight of about 710 to about 1,100; a and b are independently 2 or 3; and x is 0 to 10, preferably 1 to 6 and more preferably 2 to 5, with an ethylenically unsaturated carboxylic acid or anhydride thereof, in a charge mole ratio of the ethylenically unsaturated carboxylic acid or anhydride thereof to the succinimide of Formula VII of about 0.9:1 to about 1.05:1; and (b) reacting the succinimide product of step (a) with an acidic molybdenum compound, e.g., as disclosed in U.S. patent application Ser. No. 12/215,739, filed on Jun. 30, 2008, the contents of which are incorporated by reference herein. In one embodiment, $R^8$ is an alkyl or alkenyl group. In another embodiment, $R^8$ is a polyalkenyl group. A preferred polyalkenyl group is a polyisobutenyl group.

In step (a), a succinimide of Formula VII:

(VII)

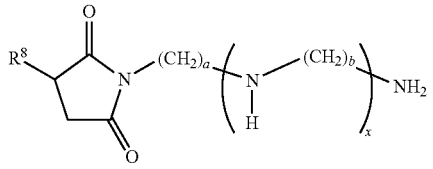

wherein $R^8$, a, b and x have the aforestated meanings, is reacted with an ethylenically unsaturated carboxylic acid in a charge mole ratio of the ethylenically unsaturated carboxylic acid or anhydride thereof to the succinimide of Formula I of about 0.9:1 to about 1.05:1. The starting succinimide of Formula VII can be obtained by reacting an anhydride of Formula VIII:

(VIII)

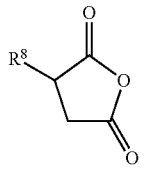

wherein $R^8$ has the aforestated meaning with a polyamine. The anhydride of Formula VIII is either commercially available from such sources as, for example, Sigma Aldrich Corporation (St. Louis, Mo., U.S.A.), or can be prepared by any method well known in the art.

Suitable polyamines for use in preparing the succinimide of Formula VII can be any of the polyamines disclosed herein above for making the succinimide of Formula V. Preferably, the polyalkylene polyamine is tetraethylenepentamine.

Generally, the anhydride of Formula VIII is reacted with the polyamine at a temperature of about 130° C. to about 220° C. and preferably from about 145° C. to about 175° C. The reaction can be carried out under an inert atmosphere, such as nitrogen or argon. The amount of anhydride of Formula VIII employed in the reaction can range from about 30 to about 95 wt. % and preferably from about 40 to about 60 wt. %, based on the total weight of the reaction mixture.

Suitable ethylenically unsaturated carboxylic acids or their anhydrides can be any of the ethylenically unsaturated carboxylic acids or their anhydrides disclosed hereinabove for making the molybdated succinimide complex employing the succinimide of Formula V. A preferred ethylenically unsaturated carboxylic acid or anhydride thereof is maleic anhydride or a derivative thereof.

Generally, the ethylenically unsaturated carboxylic acid or anhydride thereof is heated to a molten condition at a temperature in the range of from about 50° C. to about 100° C. and is thereafter mixed with the succinimide of Formula VII.

The molybdenum compounds used to prepare the molybdated succinimide complex can be any of the molybdenum compounds disclosed herein above for making the molybdated succinimide complex employing the succinimide of Formula V. Particularly preferred is molybdenum trioxide.

In step (b), a mixture of the succinimide product of step (a) and acidic molybdenum compound is prepared with or without a diluent. A diluent is used, if necessary, to provide a suitable viscosity for easy stirring. Suitable diluents are lubricating oils and liquid compounds containing only carbon and hydrogen. If desired, ammonium hydroxide may also be added to the reaction mixture to provide a solution of ammonium molybdate Generally, the reaction mixture is heated at a temperature less than or equal to about 100° C. and preferably from about 80° C. to about 100° C. until the molybdenum is sufficiently reacted. The reaction time for this step is typically in the range of about 15 minutes to about 5 hours and preferably about 1 to about 2 hours. The molar ratio of the molybdenum compound to the succinimide product of step (a) is about 0.1:1 to about 2:1, preferably from about 0.5:1 to about 1.5:1 and most preferably about 1:1. Any water present following the reaction of the molybdenum compound and succinimide product of step (a) can be removed by heating the reaction mixture to a temperature greater than about 100° C., and preferably from about 120° C. to about 160° C.

The lubricating oil compositions of the present invention will contain at least about 1100 ppm of molybdenum, based upon the total mass of the composition, provided from the one or more oil-soluble or dispersed oil-stable molybdenum-containing compounds. In one embodiment, the lubricating oil compositions of the present invention will contain about 1100 ppm to about 2000 ppm of molybdenum, based upon the total mass of the composition, provided from the one or more oil-soluble or dispersed oil-stable molybdenum-containing compounds.

In one embodiment, the oil-soluble or dispersed oil-stable molybdenum-containing compound will be present in the lubricating oil composition of the present invention such that the lubricating oil composition has a ratio of sulfur to molybdenum of less than or equal to about 4:1. In another embodiment, the lubricating oil composition has a ratio of sulfur to molybdenum of less than about 3:1. In yet another embodiment, the lubricating oil composition has a ratio of sulfur to molybdenum of about 0.5:1 to about 4:1. In another embodiment, the lubricating oil composition has a ratio of sulfur to molybdenum of about 1:1 to about 4:1. In still another embodiment, the lubricating oil composition has a ratio of sulfur to molybdenum of about 1:1 to about 3:1. In still yet another embodiment, the lubricating oil composition has a ratio of sulfur to molybdenum of about 1:1 to about 2.5:1.

The lubricating oil compositions of the present invention will have a sulfur content of up to about 0.4 wt. % and preferably up to about 0.3 wt. %. The sulfur content can be derived from elemental sulfur or a sulfur-containing compound. The sulfur or sulfur-containing compound may be intentionally added to the lubricating oil composition, or it may be present in the base oil or in one or more of the additives for the lubricating oil composition. In one embodiment, a major amount of the sulfur in the lubricating oil composition is derived from an active sulfur compound, i.e., an amount greater than 50%. By "active sulfur" is meant a sulfur compound which is antiwear active and preferably anticorrosive. The sulfur-containing compound may be an inorganic sulfur compound or an organic sulfur compound. The sulfur-containing compound may be a compound containing one or more of the groups: sulfamoyl, sulfenamoyl, sulfeno, sulfido, sulfinamoyl, sulfino, sulfinyl, sulfo, sulfonio, sulfonyl, sulfonyldioxy, sulfate, thio, thiocarbamoyl, thiocarbonyl, thiocarbonylamino, thiocarboxy, thiocyanato, thioformyl, thioxo, thioketone, thioaldehyde, thioester, and the like. The sulfur may also be present in a hetero group or compound which contains carbon atoms and sulfur atoms (and, optionally, other hetero atoms such as oxygen or nitrogen) in a chain or ring. Preferred sulfur-containing compounds include dihydrocarbyl sulfides and polysulfides such as alkyl or alkenyl sulfides and polysulfides, sulfurized fatty acids or esters thereof, ashless dithiophosphates, cyclic organo-sulfur compounds, polyisobutyl thiothione compounds, ashless dithiocarbamates and mixtures thereof.

Examples of the dihydrocarbyl sulfides or polysulfides include compounds represented by Formula VIII:

$$R^9—S_b—R^{10} \quad \text{(VIII)}$$

wherein $R^9$ and $R^{10}$ are the same or different and represent a $C_1$ to $C_{20}$ alkyl group, alkenyl group or a cyclic alkyl group, a $C_6$ to $C_{20}$ aryl group, a $C_7$ to $C_{20}$ alkyl aryl group, or a $C_7$ to $C_{20}$ aryl alkyl group; and b is an integer of 1 to 7. When each of $R^9$ and $R^{10}$ is an alkyl group, the compound is called an alkyl sulfide. Examples of the group represented by $R^9$ and $R^{10}$ in Formula VIII include methyl, ethyl, n-propyl, isopropyl, n-butyl, isobutyl, sec-butyl, ten-butyl, pentyl groups, hexyl groups, heptyl groups, octyl groups, nonyl groups, decyl groups, dodecyl groups, cyclohexyl, phenyl, naphthyl, tolyl, xylyl, benzyl, and phenethyl.

One method of preparing the aromatic and alkyl sulfides includes the condensation of a chlorinated hydrocarbon with an inorganic sulfide whereby the chlorine atom from each of two molecules is displaced, and the free valence from each molecule is joined to a divalent sulfur atom. Generally, the reaction is conducted in the presence of elemental sulfur.

Examples of alkenyl sulfides are described, for example, in U.S. Pat. No. 2,446,072. These sulfides can be prepared by interacting an olefinic hydrocarbon containing from 3 to 12 carbon atoms with elemental sulfur in the presence of zinc or a similar metal generally in the form of an acid salt. Representative examples of alkenyl sulfides include 6,6'-dithiobis (5-methyl-4-nonene), 2-butenyl monosulfide and disulfide, 2-methyl-2-butenyl monosulfide and disulfide and the like.

The sulfurized fatty acid or ester thereof can be prepared by reacting, for example, sulfur, sulfur monochloride, and/or sulfur dichloride with an unsaturated fatty acid or ester thereof under elevated temperatures. Suitable fatty acids include $C_8$ to $C_{24}$ unsaturated fatty acids such as, for example, palmitoleic acid, oleic acid, ricinoleic acid, petroselinic acid, vaccenic acid, linoleic acid, linolenic acid, oleostearic acid, licanic acid, paranaric acid, tariric acid, gadoleic acid, arachidonic acid, cetoleic acid and the like. Also useful are mixed unsaturated fatty acid, such as animal fats and vegetable oils, e.g., tall oil, linseed oil, olive oil, castor oil, peanut oil, rape oil, fish oil, sperm oil, and the like. Suitable fatty acid esters include $C_1$ to $C_{20}$ alkyl esters of the foregoing fatty acids. Exemplary fatty esters include lauryl tallate, methyl oleate, ethyl oleate, lauryl oleate, cetyl oleate, cetyl linoleate, lauryl ricinoleate, oleyl linoleate, oleyl stearate, alkyl glycerides and the like.

One class of suitable ashless dithiophosphates for use herein include those of the Formula IX:

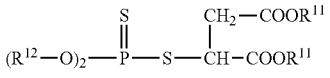

(IX)

wherein $R^{11}$ and $R^{12}$ are independently an alkyl group having 3 to 8 carbon atoms (commercially available as VANLUBE® 7611M, from R.T. Vanderbilt Co., Inc.).

Another class of suitable ashless dithiophosphates for use herein include dithiophosphoric acid esters of carboxylic acid such as those commercially available as IRGALUBE® 63 from Ciba Geigy Corp.

Yet another class of suitable ashless dithiophosphates for use herein include triphenylphosphorothionates such as those commercially available as IRGALUBE® TPPT from Ciba Geigy Corp.

Suitable polyisobutyl thiothione compounds include those compounds represented by Formula X:

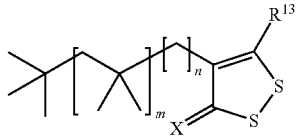

(X)

wherein $R^{13}$ is hydrogen or methyl; X is sulfur or oxygen; m is an integer from 1 to 9; and n is 0 or 1, and when n is 0 then $R^{13}$ is methyl, and when n is 1 then $R^{11}$ is hydrogen. Examples of these polyisobutyl thiothione compounds are disclosed in, for example, U.S. Patent Application Publication No. 20050153850, the contents of which are incorporated by reference herein.

In a preferred embodiment, a sulfur compound for use in the lubricating oil composition of the present invention is a bisdithiocarbamate compound of Formula XI:

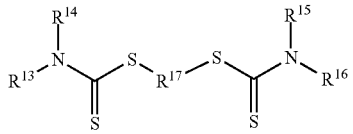

(XI)

wherein $R^{13}$, $R^{14}$, $R^{15}$, and $R^{16}$ are the same or different and are aliphatic hydrocarbyl groups having 1 to 13 carbon atoms and $R^{17}$ is an alkylene group having 1 to 8 carbon atoms. The bisdithiocarbamates of Formula XI are known compounds and described in U.S. Pat. No. 4,648,985, incorporated herein by reference. The aliphatic hydrocarbyl groups having 1 to 13 carbon atoms can be branched or straight chain alkyl groups having 1 to 13 carbon atoms. A preferred bisdithiocarbamate compound for use herein is methylenebis(dibutyldithiocarbamate) available commercially under the trademark Vanlube® 7723 (R. T. Vanderbilt Co., Inc.).

The lubricating oil compositions of the present invention can be substantially free of any phosphorus content. In one embodiment, the lubricating oil compositions of the present invention are substantially free of any zinc dialkyl dithiophosphate.

The lubricating oil compositions of the present invention may also contain other conventional additives for imparting auxiliary functions to give a finished lubricating oil composition in which these additives are dispersed or dissolved. For example, the lubricating oil compositions can be blended with antioxidants, anti-wear agents, detergents such as metal detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents, and the like and mixtures thereof. A variety of the additives are known and commercially available. These additives, or their analogous compounds, can be employed for the preparation of the lubricating oil compositions of the invention by the usual blending procedures.

Examples of antioxidants include, but are not limited to, aminic types, e.g., diphenylamine, phenyl-alpha-napthylamine, N,N-di(alkylphenyl)amines; and alkylated phenylene-diamines; phenolics such as, for example, BHT, sterically hindered alkyl phenols such as 2,6-di-tert-butylphenol, 2,6-di-tert-butyl-p-cresol, and 2,6-di-tert-butyl-4-(2-octyl-3-propanoic)phenol; and mixtures thereof.

Examples of ashless dispersants include, but are not limited to, polyalkylene succinic anhydrides; non-nitrogen containing derivatives of a polyalkylene succinic anhydride; a basic nitrogen compound selected from the group consisting of succinimides, carboxylic acid amides, hydrocarbyl monoamines, hydrocarbyl polyamines, Mannich bases, phosphonoamides, and phosphoramides; triazoles, e.g., alkyltriazoles and benzotriazoles; copolymers which contain a carboxylate ester with one or more additional polar function, including amine, amide, imine, imide, hydroxyl, carboxyl, and the like, e.g., products prepared by copolymerization of long chain alkyl acrylates or methacrylates with monomers of the above function, and the like and mixtures thereof.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of friction modifiers include, but are not limited to, alkoxylated fatty amines; fatty phosphites, fatty epoxides, fatty amines, metal salts of fatty acids, fatty acid amides, glycerol esters, and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine, and the like and mixtures thereof.

Examples of antifoaming agents include, but are not limited to, polymers of alkyl methacrylate; polymers of dimethylsilicone, and the like and mixtures thereof.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, ranges from about 0.001% to about 20% by weight, and in one embodiment about 0.01% to about 10% by weight based on the total weight of the lubricating oil composition.

The final application of the lubricating oil compositions of this invention may be, for example, in marine cylinder lubricants in crosshead diesel engines, crankcase lubricants in automobiles and railroads and the like, lubricants for heavy machinery such as steel mills and the like, or as greases for bearings and the like. In one embodiment, the lubricating oil compositions of this invention are used to lubricate a diesel engine such as a heavy duty diesel engine or a compression ignited diesel engine equipped with at least one of an exhaust gas recirculation (EGR) system; a catalytic converter; and a particulate trap.

Whether the lubricating oil composition is fluid or solid will ordinarily depend on whether a thickening agent is present. Typical thickening agents include polyurea acetates, lithium stearate, and the like.

The following non-limiting examples are illustrative of the present invention.

EXAMPLE 1

A lubricating oil composition was prepared by blending together the following components to obtain a SAE 15W-40 viscosity grade formulation:

(1) 2300 ppm, in terms of sulfur content, of a combination of a methylene bis di-n-butyl dithiocarbamate (0.7 wt. % in the finished oil) and one or more detergents, wherein 1900 ppm of sulfur is derived from active sulfur (i.e., methylene bis di-n-butyl dithiocarbamate) and 400 ppm of sulfur is derived from nonactive sulfur compound (i.e., the detergent).

(2) 400 ppm, in terms of boron content, of a combination of a borated dispersant (5.2 wt. % in the finished oil) and borated sulfonate (3 mmol/kg in the finished oil) having a total base number (TBN) of 160.

(3) 1200 ppm, in terms of molybdenum content, of a molybdenum succinimide complex.

(4) 2.6 wt. % of a dispersant.

(5) 1 wt. % of a diphenylamine antioxidant.

(6) 1 wt. % of a hindered phenol antioxidant.

(7) 0.3 wt. % of a pour point depressant.

(8) 6.6 wt. % of a dispersant viscosity index improver.

(9) 10 ppm, in terms of silicon content, of a foam inhibitor.

The remainder was diluent oil composed of approximately 72 wt. % of a CHEVRON 220N Group II base oil and approximately 28 wt. % of a CHEVRON 600N Group II base oil.

The resulting lubricating oil composition had a sulfated ash content of 0.3 wt. % as determined by ASTM D874.

COMPARATIVE EXAMPLE A

A lubricating oil composition was prepared by blending together the following components to obtain a SAE 15W-40 viscosity grade formulation:

(1) 400 ppm, in terms of sulfur content, of a nonactive sulfur compound (i.e., a detergent).

(2) 400 ppm, in terms of boron content, of a combination of a borated dispersant (5.2 wt. % in the finished oil) and borated sulfonate (3 mmol/kg in the finished oil) having a total base number (TBN) of 160.

(3) 90 ppm, in terms of molybdenum content, of a molybdenum succinimide complex.

(4) 2.6 wt. % of a dispersant.

(5) 1 wt. % of a diphenylamine antioxidant.

(6) 1 wt. % of a hindered phenol antioxidant.

(7) 0.3 wt. % of a pour point depressant.

(8) 6.6 wt. % of a dispersant viscosity index improver.

(9) 10 ppm, in terms of silicon content, of a foam inhibitor.

(10) The remainder was diluent oil composed of approximately 82 wt. % of a CHEVRON 220N Group II base oil and approximately 18 wt. % of a CHEVRON 600N Group II base oil.

The resulting lubricating oil composition had a sulfated ash content of 0.2 wt. % as determined by ASTM D874.

COMPARATIVE EXAMPLE B

A lubricating oil composition was prepared by blending together the following components to obtain a SAE 15W-40 viscosity grade formulation:

(1) 400 ppm, in terms of sulfur content, of a nonactive sulfur compound (i.e., a detergent).

(2) 750 ppm, in terms of boron content, of a combination of a borated dispersant (5.2 wt. % in the finished oil), borated calcium sulfonate (3 mmol/kg Ca basis in the finished oil) having a TBN of 160, and a dispersed hydrated sodium borate (0.5 wt. % in the finished oil).

(3) 90 ppm, in terms of molybdenum content, of a molybdenum succinimide complex.

(4) 2.6 wt. % of a dispersant.

(5) 1 wt. % of a diphenylamine antioxidant.

(6) 1 wt. % of a hindered phenol antioxidant.

(7) 0.5 wt. % of a pour point depressant.

(8) 4.1 wt. % of a dispersant viscosity index improver.

(9) 10 ppm, in terms of silicon content, of a foam inhibitor.

(10) The remainder was diluent oil composed of approximately 55 wt. % of a Group III base oil and approximately 45 wt. % of a Group II base oil.

The resulting lubricating oil composition had a sulfated ash content of 0.4 wt. % as determined by ASTM D874.

COMPARATIVE EXAMPLE C

A lubricating oil composition was prepared by blending together the following components to obtain a SAE 15W-40 viscosity grade formulation:

(1) 2300 ppm, in terms of sulfur content, of a combination of a methylene bis di-n-butyl dithiocarbamate (0.7 wt. % in the finished oil) and one or more detergents, wherein 1900 ppm of sulfur is derived from active sulfur (i.e., methylene bis di-n-butyl dithiocarbamate) and 400 ppm of sulfur is derived from nonactive sulfur compound (i.e., the detergent).

(2) 750 ppm, in terms of boron content, of a combination of a borated dispersant (5.2 wt. % in the finished oil), borated calcium sulfonate (3 mmol/kg Ca basis in the finished oil) having a TBN of 160, and a dispersed hydrated sodium borate (0.5 wt. % in the finished oil).

(3) 90 ppm, in terms of molybdenum content, of a molybdenum succinimide complex.

(4) 2.6 wt. % of a dispersant.

(5) 1 wt. % of a diphenylamine antioxidant.

(6) 1 wt. % of a hindered phenol antioxidant.

(7) 0.5 wt. % of a pour point depressant.

(8) 6.7 wt. % of a dispersant viscosity index improver.

(9) 10 ppm, in terms of silicon content, of a foam inhibitor.

(10) The remainder was diluent oil composed of approximately 72 wt. % of a CHEVRON 220N Group II base oil and approximately 28 wt. % of a CHEVRON 600N Group II base oil.

The resulting lubricating oil composition had a sulfated ash content of 0.4 wt. % as determined by ASTM D874.

Testing

API CJ-4 Cummins ISM Test

The lubricating oil compositions of Example 1 and Comparative Examples A-C were evaluated for their wear performance. A screener version of the CJ-4 Cummins engine test was used to determine heavy duty diesel valve train wear performance by measuring the injector adjusting screw weight loss (IASWL). The CJ-4 Cummins Test is a Cummins ISM engine equipped with EGR. The engine test duration is 100 hours. The results for this test are set forth below in Table 1.

TABLE 1

| | IASWL |
|---|---|
| Example 1 | 5.9 |
| Comp. Ex. A | 22.3 |
| Comp. Ex. B | 31.2 |
| Comp. Ex. C | 38.6 |

As the data show, the lubricating oil composition of Example 1 significantly reduced the injector screw wear as compared to the lubricating oil compositions of Comparative Examples A-C. Thus, it is believed that the lubricating oil composition of the present invention is capable of providing a surface film on the injector screw that will be sufficient to provide improved wear benefits.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition having a sulfur content of up to about 0.4 wt. % and a sulfated ash content of up to about 0.5 wt. % as determined by ASTM D874 and comprising (a) a major amount of an oil of lubricating viscosity; (b) at least one oil-soluble or dispersed oil-stable boron-containing compound selected from the group consisting of a borated dispersant, a borated calcium sulfonate, a borated friction modifier and mixtures thereof and having from about 40 ppm to no more than about 400 ppm of boron, based upon total mass of the composition; and (c) at least one oil-soluble or dispersed oil-stable, molybdenum succinimide complex having at least about 1100 ppm of molybdenum, based upon the total mass of the composition; wherein the lubricating oil composition has a ratio of sulfur to molybdenum of about 1.9:1 to less than or equal to about 4:1, and further wherein the sulfur content is derived from a sulfur compound selected from the group consisting of an ashless dithiocarbamate, sulfurized ester and a thiadiazole compound.

2. The lubricating oil composition of claim 1, wherein the oil of lubricating viscosity is comprised of a mineral base oil.

3. The lubricating oil composition of claim 1, having a ratio of sulfur to molybdenum of about 1.9:1 to less than about 3:1.

4. The lubricating oil composition of claim 1, having a ratio of sulfur to molybdenum of about 1.9:1 to about 2.5:1.

5. The lubricating oil composition of claim 1, wherein the oil soluble or dispersed oil-stable molybdenum succinimide complex is a sulfurized or non-sulfurized molybdenum polyisobutenyl succinimide complex.

6. The lubricating oil composition of claim 1, wherein the sulfur is derived from an ashless dithiocarbamate.

7. The lubricating oil composition of claim 1 wherein the sulfur is derived from a bisdithiocarhamate compound of the Formula:

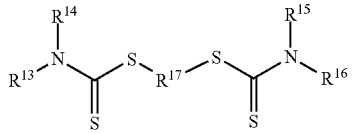

wherein $R^{13}$, $R^{14}$, $R^{15}$, and $R^{16}$ are the same or different and are aliphatic hydrocarbyl groups having 1 to 13 carbon atoms and $R^{17}$ is an alkylene group having 1 to 8 carbon atoms.

8. The lubricating oil composition of claim 1, having a sulfated ash content of up to about 0.4 wt. % as determined by ASTM D874.

9. The lubricating oil composition of claim 1, which is substantially free of phosphorus.

10. The lubricating oil composition of claim 1, which is substantially free of zinc dialkyl dithiophosphate.

11. The lubricating oil composition of claim 1, further comprising at least one additive selected from the group consisting of metallic detergents, ashless dispersants, friction modifiers, extreme pressure agents, viscosity index improvers and pour point depressants.

12. A method of operating an internal combustion engine comprising the step of operating the internal combustion engine with a lubricating oil composition having a sulfur content of up to about 0.4 wt. % and a sulfated ash content of up to about 0.5 wt. % as determined by ASTM D874 and comprising (a) a major amount of an oil of lubricating viscosity; (b) at least one oil-soluble or dispersed oil-stable boron-containing compound selected from the group consisting of a borated dispersant, a borated calcium sulfonate, a borated friction modifier and mixtures thereof and having from about 40 ppm to no more than about 400 ppm of boron, based upon the total mass of the composition; and (e) at least one oil-soluble or dispersed oil-stable molybdenum succinimide complex having at least about 1100 ppm of molybdenum, based upon the total mass of the composition; wherein the lubricating oil composition has a ratio of sulfur to molybdenum of about 1.9:1 to less than or equal to about 4:1, and further wherein the sulfur content is derived from a sulfur compound selected from the group consisting of an ashless dithiocarbamate, a sulfurized ester and a thiadiazole compound.

13. The method of claim 12, wherein the lubricating oil composition has a ratio of sulfur to molybdenum of about 1.9:1 to about 2.5:1.

14. The method of claim 12, wherein the oil-soluble or dispersed oil-stable molybdenum succinimide complex is a sulfurized or non-sulfurized molybdenum polyisobutenyl succinimide complex.

15. The method of claim 12, wherein the sulfur of the lubricating oil composition is derived from an ashless dithiocarbamate.

16. The method of claim 12, wherein the sulfur of the lubricating oil composition is derived from a bisdithiocarbamate compound of the Formula:

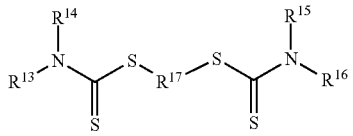

wherein $R^{13}$, $R^{14}$, $R^{15}$, and $R^{16}$ are the same or different and are aliphatic hydrocarbyl groups having 1 to 13 carbon atoms and $R^{17}$ is an alkylene group having 1 to 8 carbon atoms.

17. The method of claim 12, wherein the lubricating oil composition has a sulfated ash content of up to about 0.4 wt. % as determined by ASTM D874.

18. The method of claim 12, wherein the lubricating oil composition is substantially free of phosphorus.

19. The method of claim 12, wherein the lubricating oil composition is substantially free of zinc dialkyl dithiophosphate.

20. An internal combustion engine lubricated with the lubricating oil composition of claim 1.

21. The lubricating oil composition of claim 1, wherein the borated dispersant is selected from the group consisting of a borated polyalkenyl succinic anhydride, a borated polyalkenyl succinimide and mixtures thereof.

22. The lubricating oil composition of claim 1, wherein the borated friction modifier is selected from the group consisting of a borated fatty epoxide, a borated alkoxylated fatty amine, a borated glycerol ester and mixtures thereof.

23. The method of claim 12, wherein the borated dispersant is selected from the group consisting of a borated polyalkenyl succinic anhydride, a borated polyalkenyl succinimide and mixtures thereof.

24. The method of claim 12, wherein the borated friction modifier is selected from the group consisting of a borated fatty epoxide, a borated alkoxylated fatty amine, a borated glycerol ester and mixtures thereof.

* * * * *